US008220731B2

(12) United States Patent
Berger et al.

(10) Patent No.: US 8,220,731 B2
(45) Date of Patent: Jul. 17, 2012

(54) FOOD WASTE DISPOSER AND THREADED MOUNT SYSTEM

(75) Inventors: Thomas R. Berger, Racine, WI (US); Steven P. Hanson, Crosslake, MN (US)

(73) Assignee: Emerson Electric Co., St. Louis, MO (US)

( * ) Notice: Subject to any disclaimer, the term of this patent is extended or adjusted under 35 U.S.C. 154(b) by 236 days.

(21) Appl. No.: 12/689,008

(22) Filed: Jan. 18, 2010

(65) Prior Publication Data

US 2010/0294866 A1 Nov. 25, 2010

Related U.S. Application Data

(60) Provisional application No. 61/179,781, filed on May 20, 2009.

(51) Int. Cl.
*B02C 23/36* (2006.01)

(52) U.S. Cl. ..... 241/46.013; 241/46.014; 241/46.015

(58) Field of Classification Search . 241/46.013–46.016
See application file for complete search history.

(56) References Cited

U.S. PATENT DOCUMENTS

| | | | | |
|---|---|---|---|---|
| 2,646,222 | A | 7/1953 | Green | |
| 2,782,997 | A | 2/1957 | Wolff | |
| 2,784,915 | A | 3/1957 | Gordan | |
| 2,785,864 | A | 3/1957 | Hans | |
| 3,025,007 | A | 3/1962 | Wieczorek | |
| 3,246,132 | A | 4/1966 | Jordan et al. | |
| 3,684,199 | A | 8/1972 | Bebinger | |
| 3,693,892 | A * | 9/1972 | Musa | 241/46.016 |
| 3,801,998 | A | 4/1974 | Macias | |
| 3,880,363 | A * | 4/1975 | Guth et al. | 241/46.015 |
| 3,982,703 | A * | 9/1976 | Meyers | 241/46.015 |
| 4,135,258 | A * | 1/1979 | Braga et al. | 241/46.015 |
| 2002/0104908 | A1 * | 8/2002 | Berger et al. | 241/21 |
| 2002/0170990 | A1 * | 11/2002 | Anderson et al. | 241/46.014 |
| 2004/0256506 | A1 * | 12/2004 | Berger | 241/46.013 |
| 2007/0152087 | A1 * | 7/2007 | Pan | 241/46.016 |
| 2008/0301871 | A1 | 12/2008 | Hanson et al. | |

OTHER PUBLICATIONS

International Search Report and Written Opinion of International Application No. PCT/US2010/022729, mailed Apr. 26, 2010.

* cited by examiner

*Primary Examiner* — Bena Miller
(74) *Attorney, Agent, or Firm* — Harness, Dickey & Pierce, P.L.C.

(57) ABSTRACT

A food waste disposer and mount system has a threaded sink flange and a food waste disposer. The threaded sink flange has a tubular body portion and a flange portion extending radially outwardly from a top of the tubular body portion. The tubular body portion has a threaded portion. The food waste disposer has an upper food conveying section that includes a housing having an upper, annular portion having a threaded portion. The upper, annular portion of the housing of the upper food conveying section is threaded to the threaded portion of the tubular body portion of the threaded sink flange when the threaded sink flange is disposed in a draining opening of a sink to mount the food waste disposer to the sink.

11 Claims, 4 Drawing Sheets

FOOD WASTE DISPOSER AND THREADED MOUNT SYSTEM

CROSS-REFERENCE TO RELATED APPLICATIONS

This application claims the benefit of U.S. Provisional Application No. 61/179,781, filed on May 20, 2009. The entire disclosure of the above application is incorporated herein by reference.

FIELD

The present disclosure relates to food waste disposers and mount systems.

BACKGROUND

This section provides background information related to the present disclosure which is not necessarily prior art.

FIG. 1 depicts a vertical cross-section of a typical food waste disposer 110. The disposer may be mounted in a well-known manner in the drain opening of a sink 144 using mounting members 111 of the type disclosed in U.S. Pat. No. 3,025,007 that attach to a sink flange 146 disposed in the drain opening of sink 144. The disposer includes an upper food conveying section 112, a lower motor section 114, and a central grinding section 116 disposed between the food conveying section 112 and the motor section 114. The food conveying section 112 includes a housing 118 that forms an inlet 120 at its upper end for receiving food waste and water. Housing 118 is mounted at its upper, annular end to sink flange 146 by mounting members 111. Inlet 120 may include a baffle 142 having an outer seal portion (not shown) and an inner portion having a plurality of flaps (not shown). The housing 118 also forms a dishwasher inlet 121 for passing water discharged from a dishwasher (not shown). The food conveying section 112 conveys the food waste to the grinding section 116. The motor section 114 includes a motor 122 imparting rotational movement to a motor shaft 124. The motor 122 is enclosed within a motor housing 126

The grinding section 116 includes a grinding mechanism 135 having a rotating plate 134, a pair of lugs 136 on rotating plate 134, and a stationary shredder ring 138. The plate 134 is coupled to the motor shaft 124 of the motor 122 and rotates with motor shaft 124. The lugs 136 may be fastened to the plate 134 but are free to rotate relative to the plate 134. The grinding section 116 includes a housing 119. Housing 119 of grinding section 116 and housing 118 of food conveying section 112 may be a unitary housing and may be an injection-molded plastic housing where housings 118 and 119 are molded as a single housing. This single housing is fastened to the motor section 114 by a plurality of bolts 141 (only one of which is shown in FIG. 1).

The housing 119 of the grinding section 116 encompasses the grinding mechanism 135. The shredder ring 138, which includes a plurality of spaced teeth 140, is fixedly attached to an inner surface of the housing 119.

In the operation of the food waste disposer, the food waste delivered by the food conveying section 112 to the grinding section 116 is forced by the lugs 136 on the plate 134 against the teeth 140 of the shredder ring 138. The sharp edges of the teeth 140 grind or comminute the food waste into particulate matter sufficiently small to pass from above the plate 134 to below the plate 134 via gaps between the teeth 140 outside the periphery of the plate 134. Due to gravity, the particulate matter that passes through the gaps between the teeth 140, along with water injected into food waste disposer 110, and is discharged through a discharge outlet 150.

SUMMARY

This section provides a general summary of the disclosure, and is not a comprehensive disclosure of its full scope or all of its features.

A food waste disposer and mount system in accordance with an aspect of the present disclosure has a threaded sink flange and a food waste disposer. The threaded sink flange has a tubular body portion and an annular flange portion extending radially outwardly from a top of the tubular body portion. The tubular body portion of the sink flange has a threaded portion. The food waste disposer has an upper food conveying section, a motor section and a central grinding section disposed between the food conveying section and the motor section. The central grinding section has a housing that encompasses a grinding mechanism. The grinding mechanism has a stationary shredder ring disposed in the housing of the central grinding section and a rotatable shredder plate having lugs. The rotatable shredder plate is rotated by a motor of the motor section. The upper food conveying section includes a housing having an upper, annular portion having a threaded portion that is threaded on the threaded portion of the tubular body portion of the threaded sink flange when the threaded sink flange is disposed in a draining opening of a sink to mount the food waste disposer to the sink.

In an aspect, the tubular body portion of the threaded sink flange has an externally threaded portion and the upper, annular portion of the housing the upper food conveying section of the food waste disposer has an internally threaded portion. In an aspect, the tubular body portion of the threaded sink flange has an internally threaded portion and the upper, annular portion of the housing the upper food conveying section of the food waste disposer has an externally threaded portion.

In an aspect, a sink flange mounting nut is tightened on the threaded portion of the tubular body portion of the threaded sink flange against a bottom of the sink to secure the threaded sink flange to the sink.

In an aspect, the housing of the food conveying section includes a radially inwardly extending shoulder at a lower edge of the internally threaded portion on which a gasket is received that is compressed against a bottom of the tubular body portion of the threaded sink flange when the internally threaded portion of the upper, annular portion of the housing of the upper food conveying section is tightened on the threaded portion of the tubular body portion of the threaded sink flange.

In an aspect, the gasket has a baffle configuration.

In an aspect, a sink flange washer is received in a recess in the sink around the sink draining opening and is compressed by the flange portion of the threaded sink flange when the sink flange mounting nut is tightened on the threaded portion of the tubular body portion of the threaded sink flange.

In an aspect, the housing of the central grinding section and the housing of the upper food conveying section are a unitary plastic housing integrally molded as a single housing.

In an aspect, a lower portion of the tubular body portion of the threaded sink flange has the threaded portion which is an internally threaded portion and the threaded portion of the upper, annular portion of the housing of the upper food conveying section is an externally threaded portion. An upper portion of the tubular body portion of the threaded sink flange has an externally threaded portion on which a sink flange mounting nut is tightened against a bottom of the sink to secure the threaded sink flange to the sink. In a further aspect of this aspect, the tubular body portion of the threaded sink flange has a radially inwardly extending annular shoulder. A gasket is disposed between the radially inwardly extending annular shoulder and a top edge of the upper, annular portion of the housing of the upper food conveying section that is compressed when the upper, annular portion of the housing of the upper food conveying section is tightened to the tubular body portion of the threaded sink flange. In an aspect, the gasket has a baffle configuration.

In an aspect, the food waste disposer is mounted to the sink by placing a placing a sink flange mounting washer in a recess in the sink around a drain opening. A threaded sink flange is then placed through the sink flange mounting washer and drain opening so that a tubular body portion of the sink flange extends through the draining opening beneath the sink and a flange portion of the threaded sink flange butts against a top of the sink flange mounting washer. A sink flange mounting nut is then threaded on a threaded portion of the tubular body portion of the sink flange but not tightened. A gasket is placed on a radially extending shoulder of the housing of the upper food conveying section of the food waste disposer. An internally threaded portion of an upper, annular portion of the housing of the upper food conveying section is threaded on the threaded portion of the tubular body of the threaded sink flange and tightened on the threaded portion of the of the tubular body of the threaded sink flange to compress the gasket between the annular shoulder and a bottom of the tubular body of the threaded sink flange. The food waste disposer is rotated to orient if necessary. After the internally threaded portion of the upper, annular portion of the housing of the upper food conveying section is tightened on the threaded portion of the tubular body of the threaded sink flange, the sink flange mounting nut is tightened.

In an aspect, the food waste disposer is mounted to the sink by placing a placing a sink flange mounting washer in a recess in the sink around a drain opening. A threaded sink flange is then placed through the sink flange mounting washer and drain opening so that a tubular body portion of the sink flange extends through the draining opening beneath the sink and a flange portion of the threaded sink flange butts against a top of the sink flange mounting washer. A sink flange mounting nut is then threaded on an externally threaded upper portion of the tubular body portion of the threaded sink flange but not tightened. A gasket is placed in the tubular body portion of the threaded sink flange. An externally threaded portion of an upper, annular portion of the housing of the upper food conveying section is threaded to an internally threaded lower portion of the tubular body of the threaded sink flange and tightened to compress the gasket between a radially inwardly extending annular shoulder of the tubular body portion of the threaded sink flange and a top edge of the upper, annular portion of the housing of the upper food conveying section. The food waste disposer is rotated to orient it if necessary. After the externally threaded portion of the upper, annular portion of the housing of the upper food conveying section is tightened to the internally threaded portion of the tubular body of the threaded sink flange, the sink flange mounting nut is tightened.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
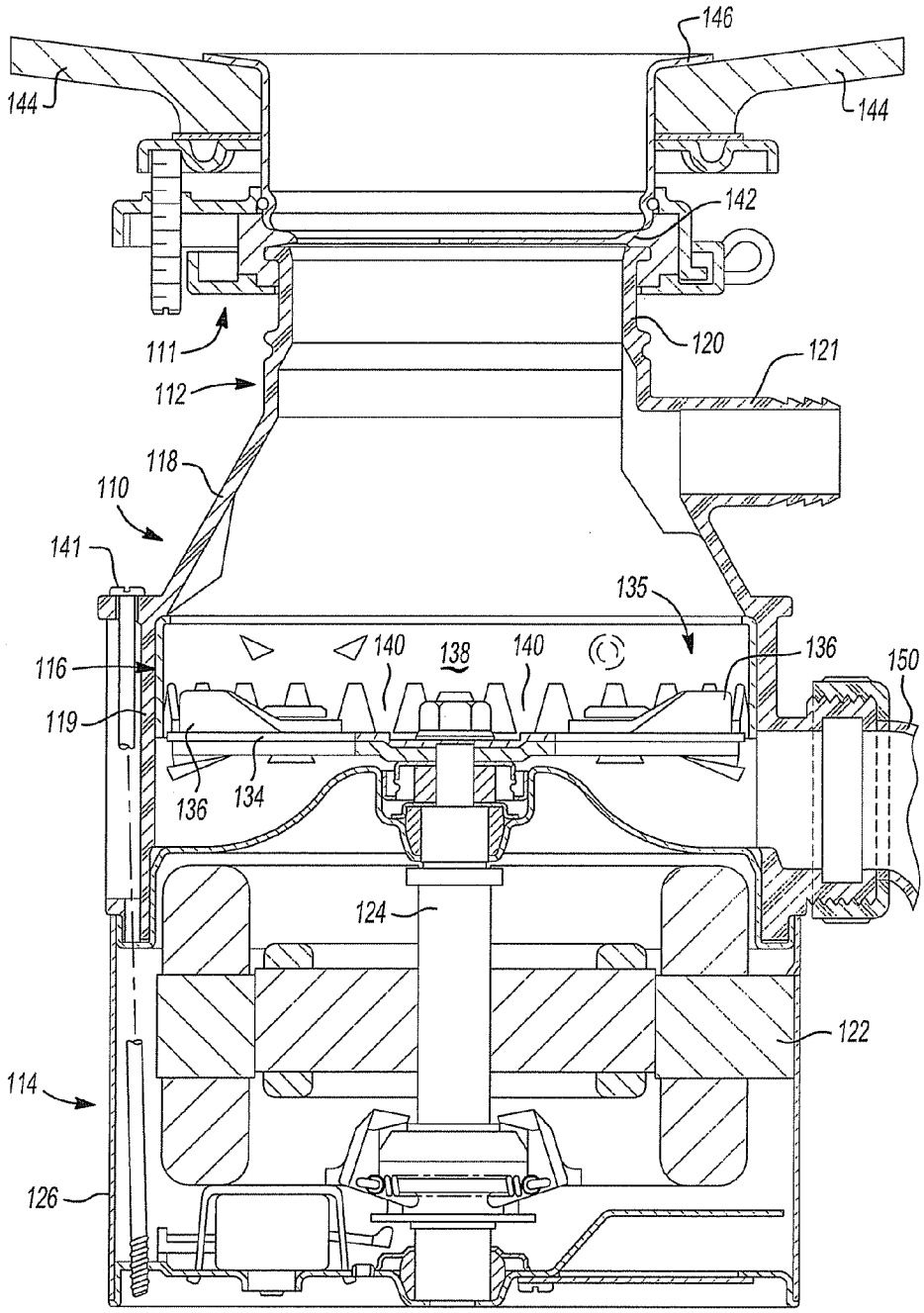
Fig-1 PRIOR ART
FIG. 1 is a cross-section of a typical prior art food waste disposer.
Figure 2:
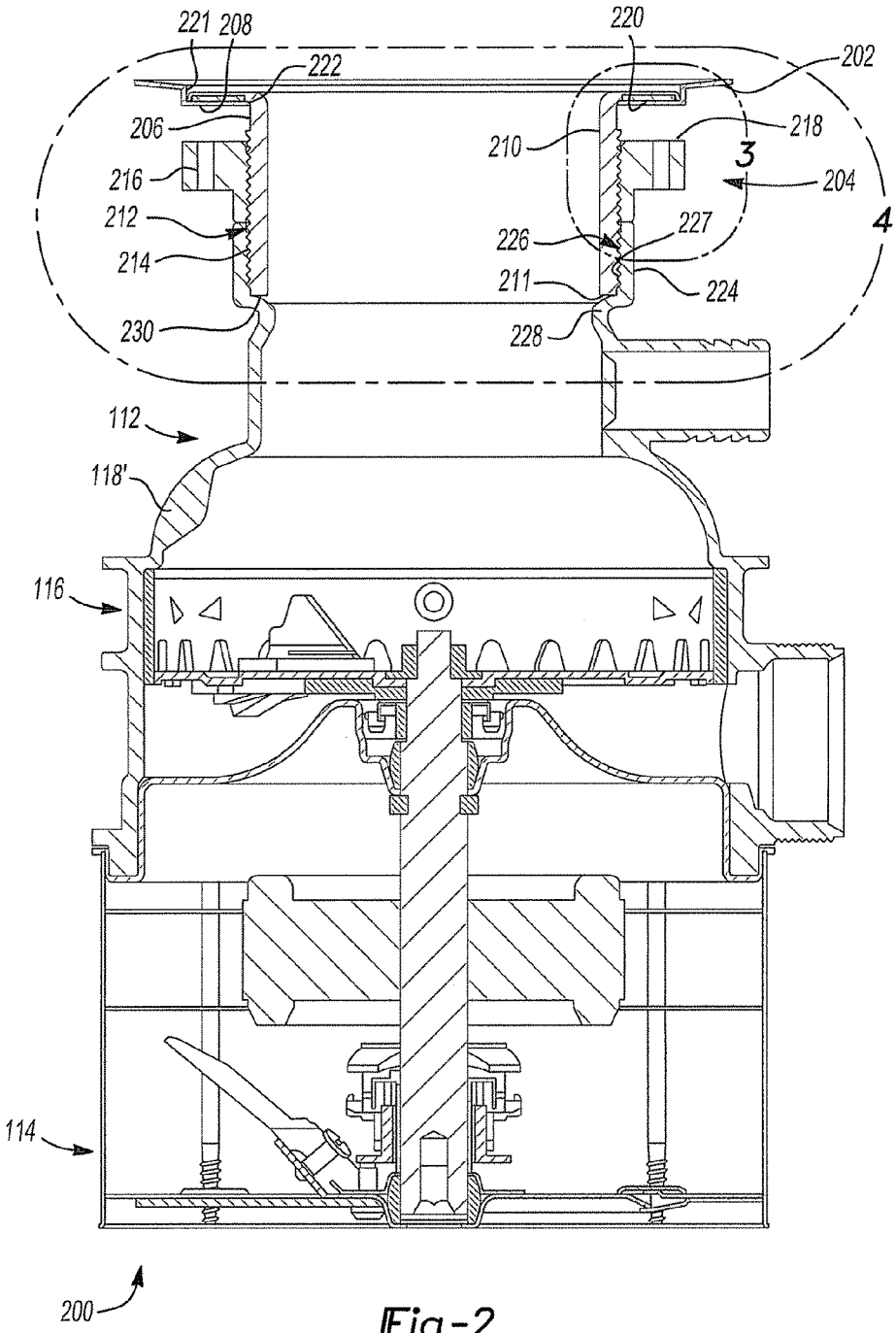
FIG. 2 is a cross-section of a food waste disposer and mount system in accordance with an aspect of the present disclosure.

Referring to FIG. 2, a food waste disposer 200 mounted to a sink 202 by a mount system 204 is shown. Food waste disposer 200 may illustratively be the same as food waste disposer 110 with the exception that housing 118' of upper food conveying section 112 differs from housing 118 as described below. Food waste disposer 200 thus includes upper food conveying section 112, lower motor section 114, and central grinding section 116 disposed between the food conveying section 112 and the motor section 114.

Figure 3:
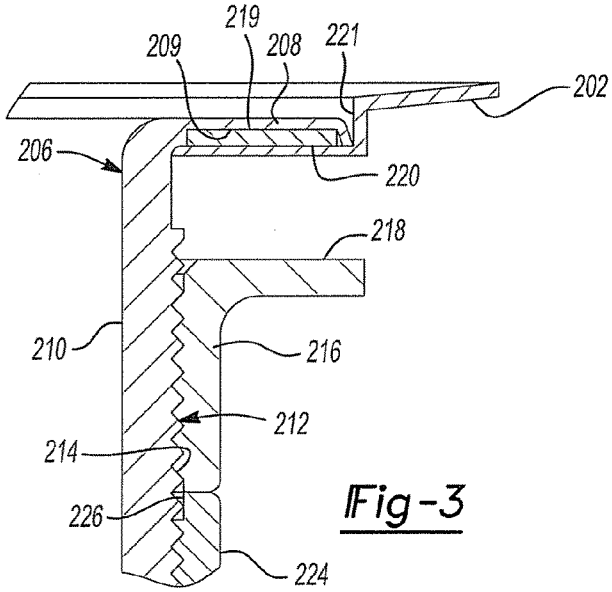
FIG. 3 is an expanded view of a portion 3-3 of FIG. 2.
Figure 4:
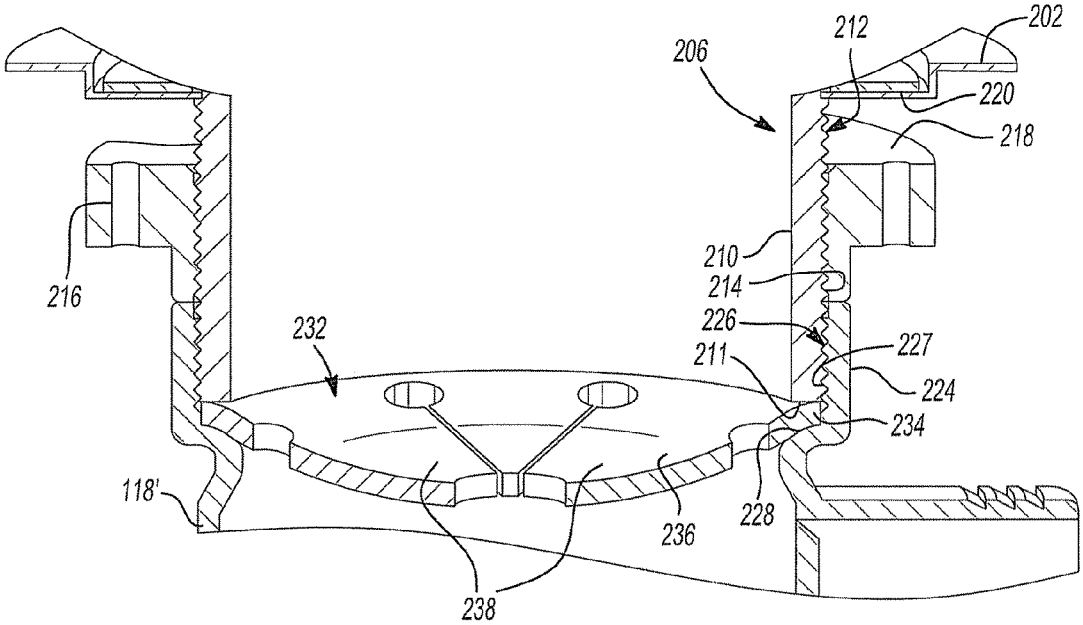
FIG. 4 is a perspective view of a section of a portion 4-4 of the food waste disposer and mount system of FIG. 2.

With reference to FIGS. 2 and 3, mount system 204 includes a threaded sink flange 206 having a flange portion 208 that extends radially outwardly from a top of a tubular body portion 210. Tubular body portion 210 extends (as oriented in FIG. 2) downwardly from flange portion 208. Tubular body portion 210 includes a threaded portion 212. In an aspect, threaded portion 212 is an externally threaded portion 214 of tubular body portion 210 as shown in FIGS. 2-4. In an aspect, threaded portion 212 extends along the length of tubular body portion 210 from a bottom 211 of tubular body portion 210 to flange portion 208, or to just short of flange portion 208, as shown in FIG. 2.

A sink flange mounting nut 216 having a top edge 218 is threaded on threaded portion 212 of threaded sink flange 206. A sink flange mounting washer 220 is received in a recess 221 of sink 202 around a sink drain opening 222. Sink flange mounting washer 220 is made of a suitable resilient sealing material, such as rubber or the like.

Housing 118' of food conveying section 112 has an upper, annular portion 224 having a threaded portion 226. In an aspect, threaded portion 226 is an internally threaded portion 227 of upper portion 224 of housing 118'. In this aspect, housing 118' has a radially inwardly extending shoulder 228 at a lower edge 230 of internally threaded portion 227. In an aspect, shoulder 228 may be spaced a slight distance from lower edge 230 of internally threaded portion 227. As shown in FIG. 4, a gasket 232 is received on shoulder 228. Gasket 232 is made of a suitable resilient sealing material, such as rubber or the like. Gasket 232 may illustratively have a baffle configuration. In one such illustrative baffle configuration, gasket 232 has an outer sealing portion 234 and an inner portion 236 having flaps 238.

To mount food waste disposer 200 to sink 202, sink flange mounting washer 220 is placed in recess 221 in sink 202 around sink drain opening 222. Threaded sink flange 206 is then inserted through sink flange mounting washer 220 and sink drain opening 222 so that tubular body portion 210 extends down through sink drain opening 222 and a bottom 209 of flange portion 208 of threaded sink flange 206 butts against a top 219 (FIG. 3) of sink flange mounting washer 220. Sink flange mounting nut 216 is then threaded onto externally threaded portion 214 of tubular body portion 210 of threaded sink flange 206 from under sink 202, but is left loose. Gasket 232 (FIG. 4) is placed in tubular portion 224 of housing 118' of food conveying section 112 of food waste disposer 200 so that it is received on shoulder 228 of housing 118' at the lower edge 230 of internally threaded portion 227 of upper end 224 of housing 118'.

Internally threaded portion 227 of upper annular portion 224 of housing 118' is then threaded onto externally threaded portion 214 of tubular body portion 210 of threaded sink flange 206 and tightened firmly on externally threaded portion 214 so that so that gasket 232 is compressed between shoulder 228 and bottom 211 of tubular body portion 210. Food waste disposer 200 and threaded sink flange 206 are then rotated if necessary to orient food waste disposer 200 properly under sink 202. Sink flange mounting nut 216 is then tightened.

Figure 5:
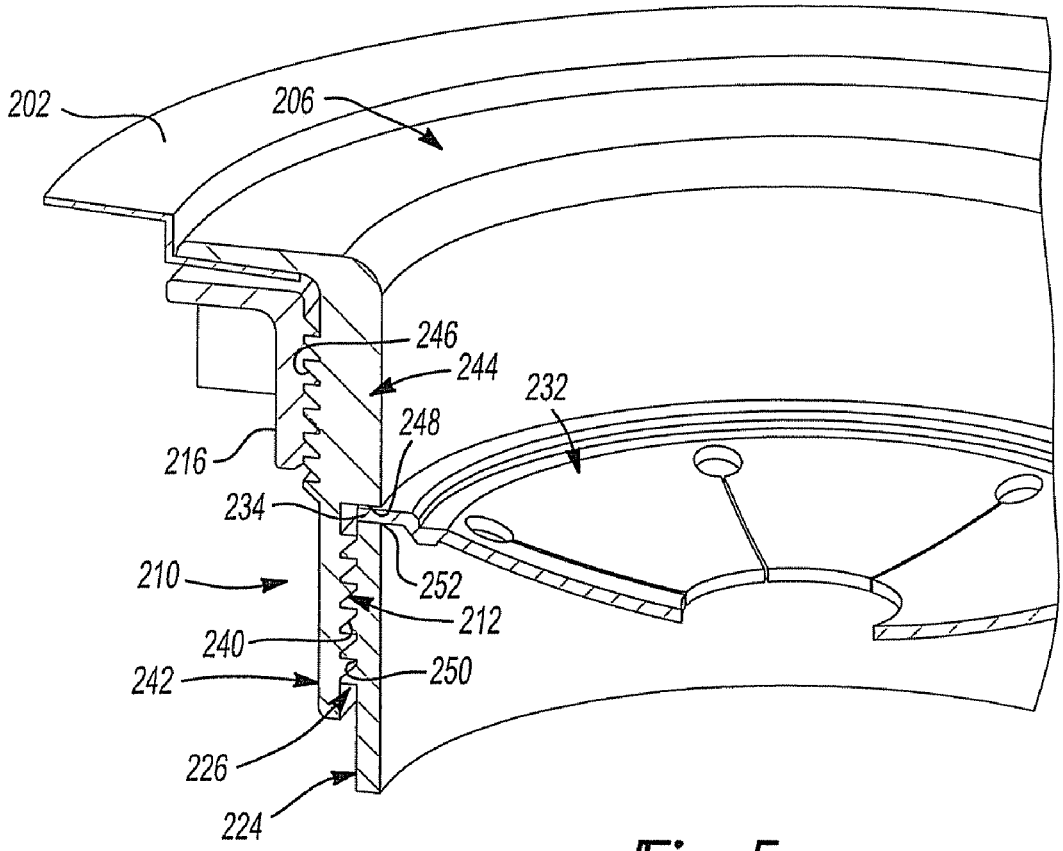
FIG. 5 is a variation of the view shown in FIG. 4.

In an alternative embodiment, threaded portion 212 of tubular body portion 210 of threaded sink flange 206 is an internally threaded portion 240 of a lower portion 242 of tubular body portion 210 as shown in FIG. 5. An upper portion 244 of tubular body portion 210 has an externally threaded portion 246. Tubular body portion 210 has a radially inwardly extending annular shoulder 248 spaced above a top of internally threaded portion 240. Threaded portion 226 of upper annular portion 224 of housing 118' of food conveying section 112 is then an externally threaded portion 250 of upper, annular portion 224.

In the embodiment shown in FIG. 5, food waste disposer 200 is mounted to sink 202 in the above described manner, with the following differences. Sink flange mounting nut 216 is threaded onto externally threaded portion 246 of tubular body portion 210 of threaded sink flange 206 from under sink 202, but is left loose. Gasket 232 is placed between a top edge 252 of tubular portion 224 and annular shoulder 248. Externally threaded portion 250 of upper, annular portion 224 of housing 118' is then threaded into internally threaded portion 240 of tubular body portion 210 of threaded sink flange 206 and tightened firmly so that outer sealing portion 234 of gasket 232 is compressed between top edge 252 of upper, annular portion 224 of housing 118' and annular shoulder 248 of tubular body portion 210 of threaded sink flange 206. Food waste disposer 200 and threaded sink flange 206 are then rotated if necessary to orient food waste disposer 200 properly under sink 202. Sink flange mounting nut 216 is then tightened.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A food waste disposer and mount system, comprising:

a threaded sink flange having a tubular body portion and a flange portion extending radially outwardly from a top of the tubular body portion, the tubular body portion having a externally threaded portion;

a food waste disposer having an upper food conveying section, a motor section and a central grinding section disposed between the food conveying section and the motor section, the central grinding section having a housing that encompasses a grinding mechanism, the grinding mechanism having a stationary shredder ring disposed in the housing of the central grinding section and a rotatable shredder plate having lugs, the rotatable shredder plate rotated by a motor of the motor section; and the upper food conveying section including a housing having an upper, annular portion having an internally threaded portion that is threaded to the threaded portion of the tubular body portion of the threaded sink flange when the threaded sink flange is disposed in a draining opening of a sink to mount the food waste disposer to the sink, the housing of the food conveying section including a radially inwardly extending shoulder at a lower edge of the internally threaded portion on which a gasket is received, the gasket disposed between the radially inwardly extending shoulder and a bottom of the tubular body portion of the threaded body portion of the threaded sink flange and compressed by the radially inwardly extending shoulder against the bottom of the tubular body portion of the threaded sink flange when the internally threaded portion of the upper, annular portion of the housing of the upper food conveying section is tightened on the externally threaded portion of the tubular body portion of the threaded sink flange.

2. The apparatus of claim 1 further including a sink flange mounting nut that is tightened on the threaded portion of the tubular body portion of the threaded sink flange against a bottom of the sink to secure the threaded sink flange to the sink.

3. The apparatus of claim 1 wherein the gasket has a baffle configuration.

4. The apparatus of claim 1 wherein the housing of the central grinding section and the housing of the upper food conveying section are a unitary plastic housing.

5. A food waste disposer and mount system, comprising:

a threaded sink flange having a tubular body portion and a flange portion extending radially outwardly from a top of the tubular body portion, the tubular body portion having a threaded portion;

a food waste disposer having an upper food conveying section, a motor section and a central grinding section disposed between the food conveying section and the motor section, the central grinding section having a housing that encompasses a grinding mechanism, the grinding mechanism having a stationary shredder ring disposed in the housing of the central grinding section and a rotatable shredder plate having lugs, the rotatable shredder plate rotated by a motor of the motor section; and the upper food conveying section including a housing having an upper, annular portion having a threaded portion that is threaded to the threaded portion of the tubular body portion of the threaded sink flange when the threaded sink flange is disposed in a draining opening of a sink to mount the food waste disposer to the sink wherein a lower portion of the tubular body portion of the threaded sink flange has the threaded portion which is an internally threaded portion and the threaded portion of the upper, annular portion of the housing of the upper food conveying section is an externally threaded portion, further including an upper portion of the tubular body portion of the threaded sink flange having an externally threaded portion on which a sink flange mounting nut is tightened against a bottom of the sink to secure the threaded sink flange to the sink.

6. The apparatus of claim 5 wherein the tubular body portion of the threaded sink flange has a radially inwardly extending annular shoulder, the apparatus further including a gasket disposed between the radially inwardly extending annular shoulder and a top edge of the housing of the upper food conveying section that is compressed when the upper, annular portion of the housing of the upper food conveying section is tightened to the tubular body portion of the threaded sink flange.

7. The apparatus of claim 6 wherein the gasket has a baffle configuration.

8. A food waste disposer, comprising:

an upper food conveying section, a motor section and a central grinding section disposed between the food conveying section and the motor section, the central grinding section having a housing that encompasses a grinding mechanism, the grinding mechanism having a stationary shredder ring disposed in the housing of the central grinding section and a rotatable shredder plate having lugs, the rotatable shredder plate rotated by a motor of the motor section; and the upper food conveying section including a housing having an upper, annular portion having an internally threaded portion that is threadable to a threaded sink flange disposed in a drain opening of a sink to mount the food waste disposer to the sink; the housing of the food conveying section including a radially inwardly extending shoulder at a lower edge of the internally threaded portion on which a gasket is received, the gasket disposed between the radially inwardly extending shoulder and a bottom of the sink flange and compressed by the radially inwardly extending shoulder against the bottom of the threaded sink flange when the internally threaded portion of the upper, annular portion of the housing of the upper food conveying section is tightened on the threaded sink flange.

9. The apparatus of claim 8 wherein the gasket has a baffle configuration.

10. A method of mounting a food waste disposer to a sink, the food waste disposer having an upper food conveying section, a motor section and a central grinding section disposed between the food conveying section and the motor section, the central grinding section having a housing that encompasses a grinding mechanism, the grinding mechanism having a stationary shredder ring disposed in the housing of the central grinding section and a rotatable shredder plate having lugs, the rotatable shredder plate rotated by a motor of the motor section, the upper food conveying section including a housing having an upper, annular portion having an internally threaded portion and a radially inwardly extending shoulder at a lower edge of the threaded portion, the method comprising:

placing a sink flange mounting washer in a recess in the sink around a drain opening;

placing a threaded sink flange through the sink flange mounting washer and drain opening so that a tubular body portion of the sink flange extends through the drain opening beneath the sink and a flange portion of the threaded sink flange butts against a top of the sink flange mounting washer;

threading a sink flange mounting nut on a threaded portion of the tubular body portion of the sink flange but leaving it loose;

placing a gasket on the radially inwardly extending shoulder of the housing of the upper food conveying section of the food waste disposer;

threading the internally threaded portion of the upper, annular portion of the housing of the upper food conveying section on the threaded portion of the tubular body of the threaded sink flange and tightening it on the threaded portion of the of the tubular body of the threaded sink flange to compress the gasket between the annular shoulder and a bottom of the tubular body of the threaded sink flange and then rotating the food waste disposer to orient it if necessary; and after tightening the internally threaded portion of the upper, annular portion of the housing of the upper food conveying section on the threaded portion of the tubular body of the threaded sink flange, tightening the sink flange mounting nut.

11. A method of mounting a food waste disposer to a sink, the food waste disposer having an upper food conveying section, a motor section and a central grinding section disposed between the food conveying section and the motor section, the central grinding section having a housing that encompasses a grinding mechanism, the grinding mechanism having a stationary shredder ring disposed in the housing of the central grinding section and a rotatable shredder plate having lugs, the rotatable shredder plate rotated by a motor of the motor section, the upper food conveying section including a housing having an upper, annular portion having an externally threaded portion, the method comprising:

placing a sink flange mounting washer in a recess in the sink around a drain opening;

placing a threaded sink flange through the sink flange mounting washer and drain opening so that a tubular body portion of the sink flange extends through the drain opening beneath the sink and a flange portion of the threaded sink flange butts against a top of the sink flange mounting washer;

threading a sink flange mounting nut on an externally threaded upper portion of the tubular body portion of the threaded sink flange but not tightening it;

placing a gasket on a top edge of the upper annular portion of the housing of the upper food conveying section of the food waste disposer;

threading the externally threaded portion of the upper, annular portion of the housing of the upper food conveying section to an internally threaded lower portion of the tubular body portion of the threaded sink flange and tightening it to compress the gasket between a radially inwardly extending annular shoulder of the tubular body portion of the threaded sink flange and the top edge of the upper, annular portion of the housing of the upper food conveying section and then rotating the food waste disposer to orient it if necessary; and after tightening the externally threaded portion of the upper, annular portion of the housing of the upper food conveying section to the internally threaded lower portion of the of the tubular body portion of the threaded sink flange, tightening the sink flange mounting nut.

* * * * *